US009513049B2

(12) United States Patent
Eisele et al.

(10) Patent No.: US 9,513,049 B2
(45) Date of Patent: Dec. 6, 2016

(54) REFRIGERATOR WITH BOTTOM MOUNT FREEZER WITH MULTIPLE SLIDING DRAWERS

(75) Inventors: Frank Eisele, Neu-Ulm (DE); Ralph Staud, München (DE); Thomas Tischer, Haar (DE)

(73) Assignee: BSH Hausgeräte GmbH, Munich (DE)

( * ) Notice: Subject to any disclaimer, the term of this patent is extended or adjusted under 35 U.S.C. 154(b) by 572 days.

(21) Appl. No.: 12/681,003

(22) PCT Filed: Sep. 17, 2008

(86) PCT No.: PCT/EP2008/062355

§ 371 (c)(1),
(2), (4) Date: Mar. 31, 2010

(87) PCT Pub. No.: WO2009/049983

PCT Pub. Date: Apr. 23, 2009

(65) Prior Publication Data

US 2010/0218546 A1 Sep. 2, 2010

(30) Foreign Application Priority Data

Oct. 10, 2007 (DE) ..... 10 2007 048 575

(51) Int. Cl.
*F25D 25/02* (2006.01)
*F25D 23/02* (2006.01)
*F25D 23/08* (2006.01)

(52) U.S. Cl.
CPC ..... *F25D 25/025* (2013.01); *F25D 23/021* (2013.01); *F25D 23/087* (2013.01);

(Continued)

(58) Field of Classification Search
CPC .... F25D 25/02; F25D 25/021; F25D 25/024; F25D 25/0252; F25D 25/028
USPC ..... 62/382, 465; 312/204, 295, 308, 402, 312/404; 220/592.02, 23.83
See application file for complete search history.

(56) References Cited

U.S. PATENT DOCUMENTS 2,709,343 A * 5/1955 Muffly ..... 62/234
4,788,832 A * 12/1988 Aoki et al. ..... 62/382

(Continued)

FOREIGN PATENT DOCUMENTS

CN 1683868 A 10/2005
JP 2000266453 A 9/2000

(Continued)

OTHER PUBLICATIONS

RU2010115839 Granting Decision.

(Continued)

*Primary Examiner* — Marc Norman
*Assistant Examiner* — David Teitelbaum
(74) *Attorney, Agent, or Firm* — Nixon & Vanderhye P.C.

(57) ABSTRACT

A refrigerator having an insulated interior which is formed, at least in part, by a drawer with a bottom boundary wall, a front boundary wall, two lateral boundary walls and a rear boundary wall. Included at an upper portion of the drawer is an inner drawer, of which the height is smaller than the height of the drawer. According to the invention, the height of the rear boundary wall of the drawer is reduced at least to the extent where the inner drawer can have its base wall displaced, at least in part, beyond the rear boundary wall of the drawer.

17 Claims, 3 Drawing Sheets

(52) U.S. Cl.
CPC ..... *F25D 25/02* (2013.01); *F25D 25/021* (2013.01); *F25D 25/022* (2013.01); *F25D 25/024* (2013.01); *F25D 25/028* (2013.01); *F25D 2331/803* (2013.01); *F25D 2331/809* (2013.01)

(56) References Cited

U.S. PATENT DOCUMENTS

| | | | | |
|---|---|---|---|---|
| 5,417,080 | A * | 5/1995 | Bishop | 62/376 |
| 6,941,766 | B2 | 9/2005 | Wood | |
| 2003/0173881 | A1* | 9/2003 | Gomoll | A47B 67/04 312/404 |
| 2005/0061021 | A1* | 3/2005 | Uihlein et al. | 62/441 |
| 2006/0043848 | A1 | 3/2006 | Jeong et al. | |
| 2006/0266070 | A1* | 11/2006 | Ertz | F25D 25/025 62/441 |
| 2007/0018548 | A1 | 1/2007 | Ertz et al. | |
| 2007/0035221 | A1 | 2/2007 | Koo | |
| 2007/0262686 | A1* | 11/2007 | Ji | 312/402 |

FOREIGN PATENT DOCUMENTS

| | | | |
|---|---|---|---|
| JP | 2001004262 | A | 1/2001 |
| JP | 2002-264943 | A | 9/2002 |
| JP | 2004293991 | A | 10/2004 |
| JP | 2006090686 | A | 4/2006 |
| RU | 2276759 | C2 | 5/2006 |
| WO | 2004053407 | A1 | 6/2004 |
| WO | 2007010267 | A2 | 1/2007 |
| WO | 2008056910 | A1 | 5/2008 |

OTHER PUBLICATIONS

Granting Decision of Patent Right Including National Search Report CN 2008801108730 dated Feb. 8, 2013.

* cited by examiner

REFRIGERATOR WITH BOTTOM MOUNT FREEZER WITH MULTIPLE SLIDING DRAWERS

BACKGROUND OF THE INVENTION

Refrigerators have become known which have a drawer in their lower compartment for the purpose of storing refrigerated or frozen food items. Said drawer is fully insulated such that it does not need to be accessed by a door on the front of the refrigerator. The drawer is directly accessible from the front of the refrigerator and can be opened simply by pulling it out. Drawers of this type are very easily accessible since, in contrast to an interior space closed by means of a door, they can be filled and emptied from above.

In order to enable the space that is available in the drawer to be used more efficiently, inserts are often provided in the upper region of the drawer. These inserts can be lifted out in order to ensure access to the space located thereunder. However, movable inserts have also become known whose depth is less than the depth of the drawer. In this way, with the insert pushed toward the rear, there is access to the food items stored in the front region of the drawer, whereas when the insert is pushed toward the front, there is access to the rear region of the drawer. However, since these inner drawers are generally only half as deep as the drawer, the space available in the inner drawers is very limited.

BRIEF SUMMARY OF THE INVENTION

The object underlying the invention is to embody a refrigerator in such a way that the inner drawer can be dimensioned with practically the same depth as the drawer without this adversely affecting accessibility to the food items stored in the lower region of the drawer.

The object is achieved according to the invention by means of a refrigerator where a height of the rear boundary wall of the drawer is reduced at least to such an extent that the inner drawer can be displaced with its base wall at least in part beyond the rear boundary wall, and the inner drawer can be pushed so far to the rear when the drawer is open that the food items stored in the drawer are freely accessible.

The rear boundary wall of the drawer is advantageously reduced by at least the greatest height of the inner drawer. This ensures that the inner drawer can be pushed back all the further into the interior of the refrigerator, the further the drawer is pulled out. If the drawer is withdrawn completely, the inner drawer can be pushed back completely so that the food items stored in the rear part of the drawer are also freely accessible.

In order to enable the total insulation of the interior space formed by the drawer to be guaranteed when the drawer is in the closed state, the drawer has a lid. Said lid is immovably joined to the refrigerator. Joined to the lid is a rear wall which, when the drawer is inserted, cooperates in a sealing manner with the rear boundary wall of the drawer. When the drawer is withdrawn, the lid remains in its place in the refrigerator and thus allows access to the drawer from its top side. In this way the drawer can be filled and emptied in the open state without the lid first having to be removed or pushed to the side. After the drawer is closed, a completely insulated interior space is produced once again without the user having to be concerned with securely closing the drawer by means of the lid.

The lid can be assigned an evaporator for cooling the interior space of the drawer. In this way the drawer complete with lid can be designed as a module which includes all the necessary functions and so can be incorporated into a refrigerator as a freezer compartment for example.

For this purpose the evaporator is advantageously integrated into the lid. In this way the corresponding air ducts and a fan can also be provided in the lid. The air ducts can be designed in such a way that they can also supply cold air to a refrigerator compartment located above the drawer.

The lid advantageously has side parts and a rear wall, wherein the bottom edges of the side parts are matched to fit the top edges of the lateral boundary walls of the drawer. In this way it is ensured that when in the inserted state the drawer together with the lid delimits an interior space that is closed on all sides.

The top edges of the lateral boundary walls of the drawer run diagonally from the top edge of the front boundary wall to the top edge of the rear boundary wall. When the drawer is inserted a certain pressure is thus generated between the top edges of the lateral boundary walls of the drawer and the bottom edges of the side walls of the lid. This enables the seal tightness of the delimited interior space to be increased.

The lid and the boundary walls of the drawer advantageously consist of thermally insulating material. In the closed state of the drawer, drawer and lid thus form a fully insulated interior space. There is no necessity for an additional insulation of the refrigerator housing enclosing the drawer and the lid.

Sealing means are particularly advantageously provided between the peripheral top edge of the drawer on the one side and the peripheral bottom edge of the lid on the other. Said sealing means cause the interior space to be sealed off even more effectively from the environment. In this way the insulation effect can be increased even further.

The inner drawer is displaceably mounted in such a way that it can be moved beyond the rear boundary wall of the drawer into the interior space of the refrigerator when the drawer is withdrawn. For that purpose the inner drawer can be mounted on the lid by way of telescopic rails for example. Advantageously, however, the inner drawer is mounted in the drawer itself.

The depth of the inner drawer is advantageously embodied at least in part shorter than the depth of the drawer. This allows food items that take up the full height of the drawer to be stored in the drawer as well. This shorter depth can, however, be restricted to one side of the inner drawer, while the other side has approximately the same depth as the drawer. A holder for bottles placed upright can be provided in the drawer in the area having the shorter depth. If said holder is located in the front part of the drawer, the drawer only has to be opened by a small amount in order to remove the bottles. In this way the heat exchange with the environment can be reduced to a minimum.

BRIEF DESCRIPTION OF THE DRAWINGS

Further details and advantages of the invention will emerge from the dependent claims in connection with the description of an exemplary embodiment which is explained in greater depth with reference to the drawing, in which:

DETAILED DESCRIPTION OF EXEMPLARY EMBODIMENTS OF THE PRESENT INVENTION

In the illustrated exemplary embodiment only the lower part of a refrigerator is shown, so that only a part of the rear wall is visible also. A conventional interior space closed by means of a door toward the front could be located above the area shown. However, the invention can also be implemented in a refrigerator whose interior space is accessible exclusively via a drawer.

Figure 1:
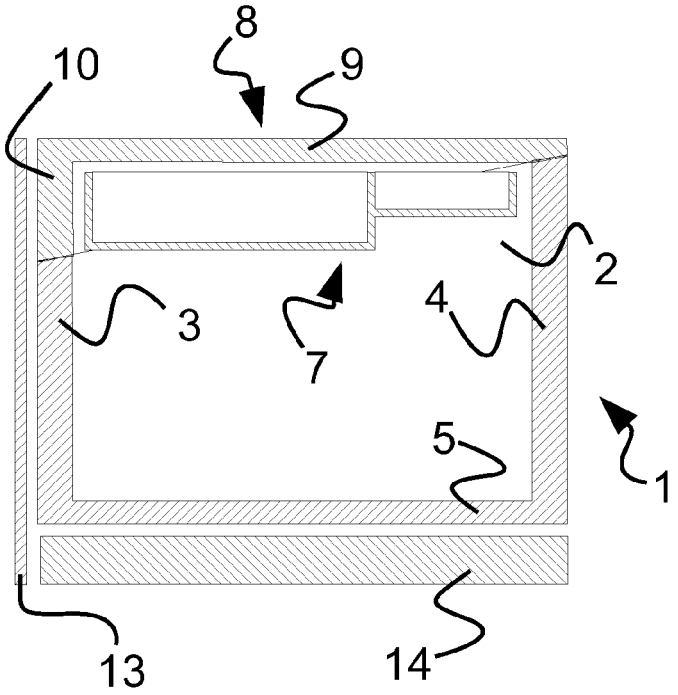
FIG. 1 is a cross-sectional view along line 1-1 in FIG. 5.

FIG. 1 shows a drawer 1 which has a bottom boundary wall 5, a rear boundary wall 3 and a front boundary wall 4. Only the rear of the lateral boundary walls 2 can be seen in this view. The boundary walls 2, 3, 4 and 5 form an interior space which has an opening at its top side. In the closed state of the drawer 1 shown in FIG. 1 the top opening is closed by means of the lid 8. The latter consists of a cover plate 9, a rear wall 10 and the side walls 11 (see FIG. 2). Here, too, only the rear side wall of the side walls 11 of the lid can be seen in each case in the views shown. The bottom edges 12 of the lid 8 run diagonally. The top edges 6 (see FIG. 3) of the drawer 1 run at the same angle. In the closed state the top edges 6 of the drawer 1 are thus in contact with the bottom edges 12 of the lid 8. The drawer 1 and the lid 8 are surrounded by a housing, of which only a part of the rear wall 13 and the base 14 can be seen here.

The inner drawer 7 is located in the upper region of the drawer 1. The inner drawer 7 is connected to the drawer 1 by way of drawer runners that are not shown here. The drawer 1 is connected to the housing of the refrigerator in the same way.

Figure 4:
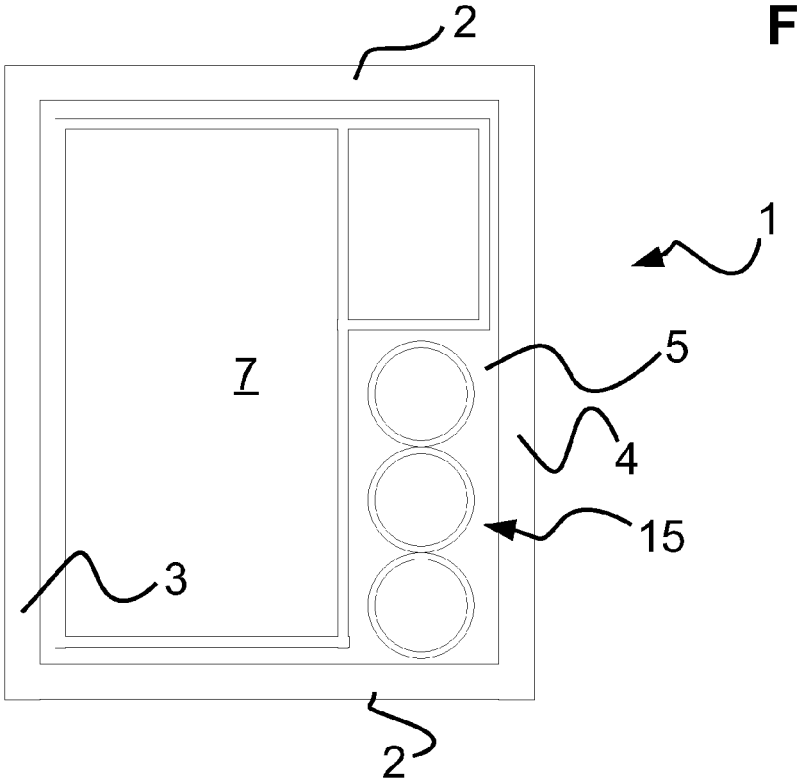
FIG. 4 is a plan view of the drawer and inner drawer.
Figure 5:
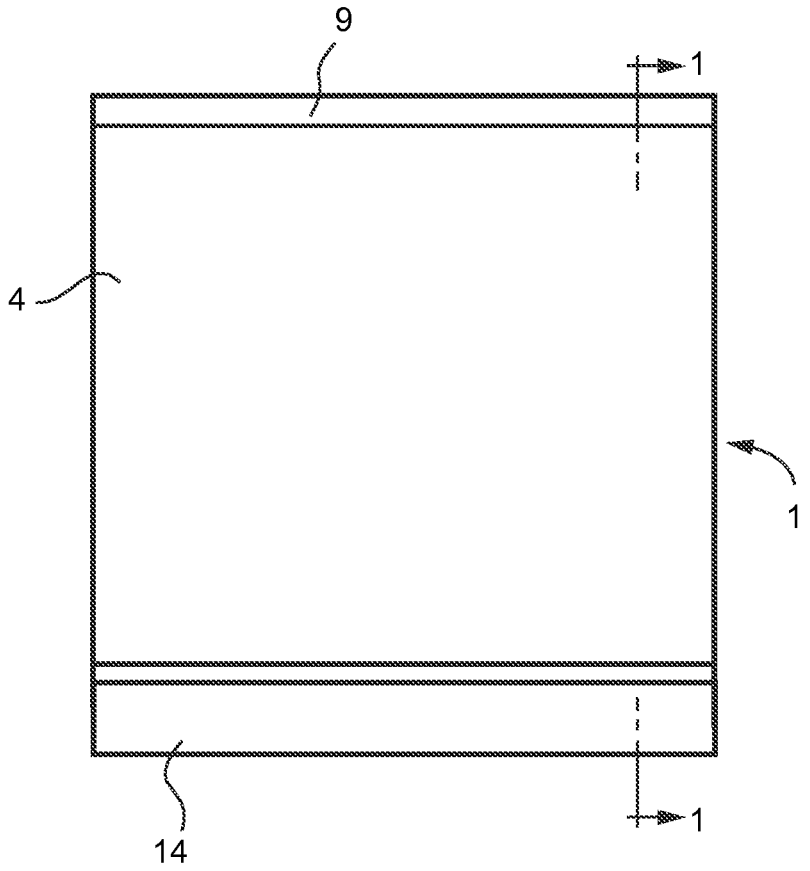
FIG. 5 is a front view of a lower section of a refrigerator showing a drawer in accordance with the disclosed technology.

The depth of the inner drawer 7 is dimensioned such that it fits fully into the drawer 1. This means that the external dimensions of the inner drawer roughly correspond to the internal dimensions of the drawer. Consequently the opening cross-section of the drawer 1 is almost completely filled out by the inner drawer 7. In the front region the inner drawer 7 has a cutout through which the bottom boundary wall 5 of the drawer is visible in FIG. 4. The front region of the inner drawer 7 which is disposed next to said cutout has a shorter height than the rear section of the inner drawer 7.

In an exemplary embodiment not shown in the drawing, the lid 8 can also be designed as hollow, with an evaporator and a fan being provided therein. Air ducts can also be provided which draw air from the interior space of the drawer, direct it across the evaporator and feed the thus cooled air back to the interior space of the drawer.

The arrangement shown enables very different food items to be arranged in the drawer in such a way that the space available is used to optimal effect and nonetheless excellent accessibility to the food items is ensured. Thus, the rear region of the drawer 1 can be filled with items roughly corresponding in height to the height of the rear boundary wall 3 of the drawer 1. Even taller items can be accommodated in the front part of the drawer 1. In the region of the cutout of the inner drawer 7 the height of the items can even attain the height of the front boundary wall 4 of the drawer 1. This space is particularly well suited to accommodating bottles. For that purpose a bottle holder 15 is installed on the bottom boundary wall 5 of the drawer 1 underneath the cutout of the inner drawer 7. Bottles can be securely and stably stored here.

In the closed state shown in FIG. 1, the insulated boundary walls 2, 3, 4, 5 of the drawer 1 and the lid 8 with its side walls 2, the rear wall 10 and the cover plate 9 form a complete enclosure for an interior space that is suitable for storing refrigerated or frozen food items. Also contained in this insulated interior space is the inner drawer 7, which can likewise be used for storing refrigerated or frozen food items. If it is now desired to fill this interior space or to remove something from the interior space, the drawer 1 is withdrawn to the front.

Figure 2:
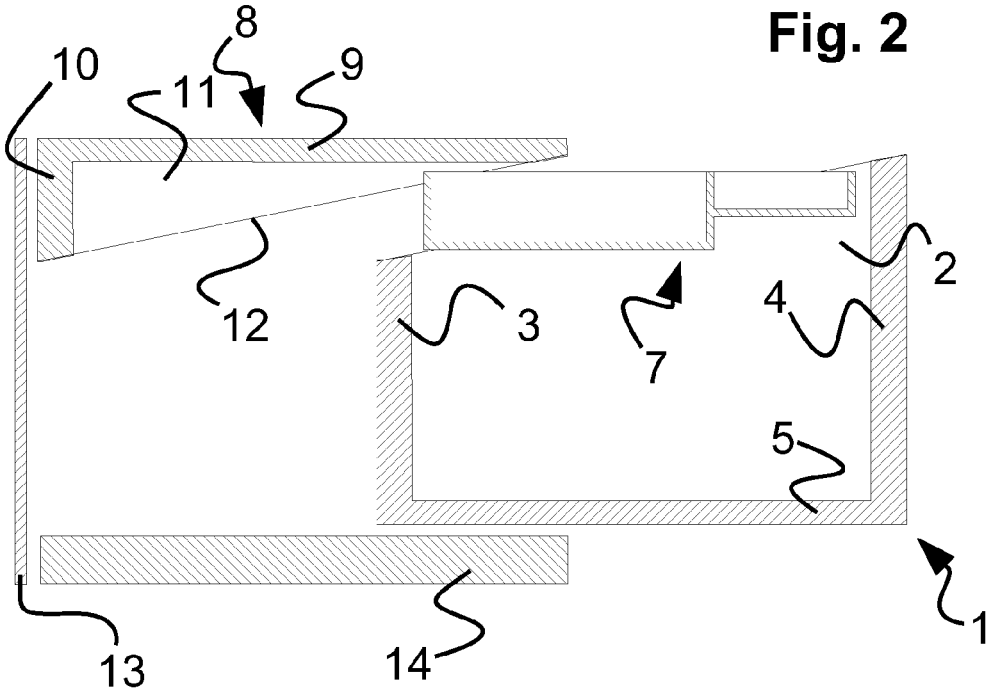
FIG. 2 is a cross-sectional view similar to FIG. 1 showing the refrigerator with the drawer open in a position which ensures the inner drawer can be emptied and filled.

The state shown in FIG. 2 does not yet show the end position which can be reached when drawer runners are used. In the open position of the drawer 1 it is now possible to access the inner drawer 7. Depending on the position of the drawer 1, only the front region of the inner drawer 7 can be accessed, or if the drawer 1 is fully withdrawn, the rear region also becomes accessible. To remove bottles accommodated in the bottle holder 15 from the drawer 1, the drawer only needs to be opened a crack. In this way a more intense heating of the interior space due to the exchange with the ambient air can be prevented.

Figure 3:
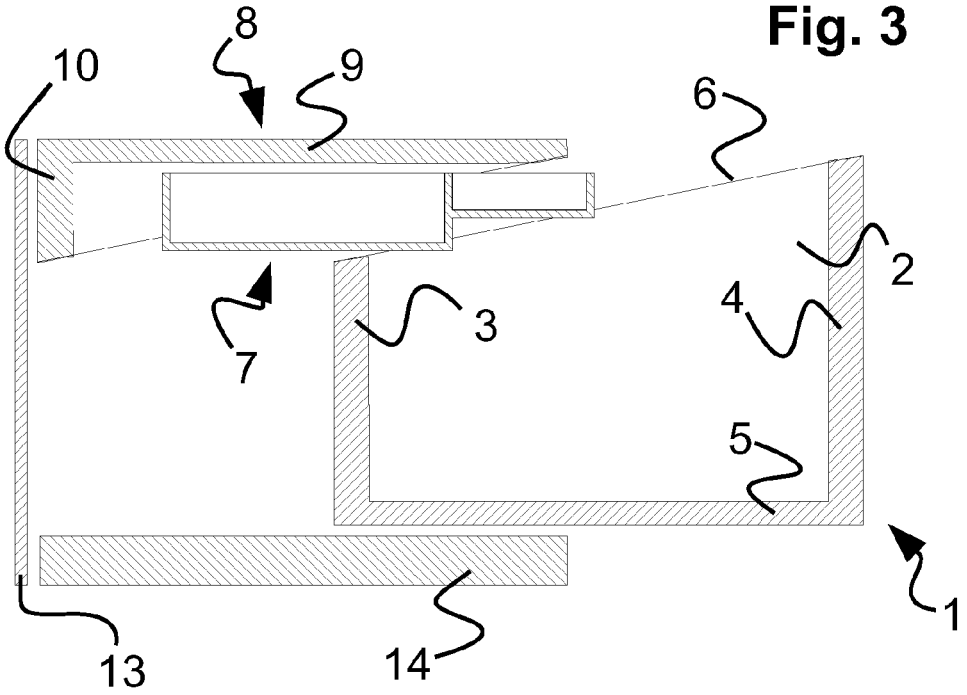
FIG. 3 is a cross-sectional view similar to FIG. 1 showing the refrigerator with the drawer open and the inner drawer inserted.

If the rear region of the drawer 1 is now to be accessed, the inner drawer 7 can be pushed in toward the rear beyond the rear boundary wall 3 of the drawer 1 into the refrigerator housing. With the drawer 1 fully withdrawn and the inner drawer 7 fully inserted, the opening cross-section of the drawer 1 is in this way revealed over its total area. In this position it is possible to fill and empty the drawer 1 without problems. FIG. 3 shows an intermediate position in which the inner drawer 7 has not yet been fully inserted and the drawer 1 has not yet been fully withdrawn. Sealing means (not shown here) are provided between the top edge 6, the drawer 1 and the bottom edge 12 of the lid 8 in order to ensure the interior space is reliably sealed off from the ambient air when the drawer 1 is in the closed state. For the seal tightness of the interior space it is irrelevant here whether the sealing means are attached to the bottom edge 12 of the lid or to the top edge 6 of the drawer 1. Fixing said means to the bottom edge 12 of the lid 8 does however reduce the risk of damage being caused to the seal during filling or emptying.

LIST OF REFERENCE SIGNS

1 Drawer
2 Lateral boundary walls
3 Rear boundary wall
4 Front boundary wall
5 Bottom boundary wall
6 Top edge of the drawer
7 Inner drawer
8 Lid
9 Cover plate
10 Rear wall of the lid
11 Side walls of the lid
12 Bottom edge of the lid
13 Rear wall of the refrigerator
14 Base of the refrigerator
15 Bottle holder

The invention claimed is:

1. A refrigerator, comprising:

a housing;

a first drawer slidably disposed in the housing between a withdrawn position and an inserted position, the first drawer including a bottom boundary wall, a front boundary wall, two lateral boundary walls, and a rear boundary wall; and an inner drawer disposed in an upper region of the first drawer and including a storage area to accommodate food items within the storage area, the storage area having a front section with a shorter depth than a depth of the first drawer and a rear section that extends to a depth that is approximately the same as the depth of the first drawer, wherein the front section has a cutout in plan view through which the bottom boundary wall of the first drawer is visible such that an item having a height substantially equal to a height of the front boundary wall can be accommodated in the first drawer in an area corresponding to the cutout without interference from the inner drawer when the first drawer is in the inserted position, wherein the cutout extends to a front edge of the inner drawer and extends to a lateral edge of the inner drawer such that the cutout is directly opposed to the front boundary wall when the first drawer is in the inserted positions, and wherein depth is measured in a direction extending from the front boundary wall to the rear boundary wall.

2. The refrigerator as claimed in claim 1, wherein a portion of the front section of the inner drawer disposed laterally next to the cutout has a height shorter than a height of the rear section of the inner drawer.

3. The refrigerator as claimed in claim 1, wherein the first drawer includes a lid which is immovably joined to the refrigerator, said lid has a rear wall, when the first drawer is disposed in the inserted position said rear wall cooperates in a sealing manner with the rear boundary wall of the first drawer.

4. The refrigerator as claimed in claim 3, wherein the lid further includes side walls, and wherein bottom edges of the side walls abut against top edges of the lateral boundary walls of the first drawer in a sealing manner when the first drawer is in the inserted position.

5. The refrigerator as claimed in claim 1, wherein at least one of the boundary walls of the first drawer includes a thermally insulating material.

6. A refrigerator, comprising:

a housing;

a first drawer slidably disposed in the housing between a withdrawn position and an inserted position, the first drawer including lateral boundary walls, a bottom boundary wall, a rear boundary wall and a front boundary wall forming an interior space with an opening at a top side thereof; and an inner drawer provided in an upper region of the first drawer and including a storage area to accommodate food items within the storage area, the storage area having, at a front section of the storage area, a cutout in plan view through which the bottom boundary wall of the first drawer is visible such that an item having a height substantially equal to a height of the front boundary wall can be accommodated in the first drawer in an area corresponding to the cutout without interference from the inner drawer when the first drawer is in the inserted position, wherein the cutout extends to a front edge of the inner drawer and extends to a lateral edge of the inner drawer such that the cutout is directly opposed to the front boundary wall when the first drawer is in the inserted position, and wherein a portion of the front section of the inner drawer disposed laterally next to the cutout has a height shorter than a height of a rear section of the inner drawer.

7. The refrigerator as claimed in claim 6, wherein a height of the rear boundary wall of the first drawer is reduced at least by a greatest height of the inner drawer.

8. The refrigerator as claimed in claim 6, wherein the first drawer includes a lid which is immovably joined to the refrigerator, said lid has a rear wall, when the first drawer is disposed in the inserted position said rear wall cooperates in a sealing manner with the rear boundary wall of the first drawer.

9. The refrigerator as claimed in claim 8, wherein the lid is operable to be used in cooperation with an evaporator for cooling the interior space of the first drawer.

10. The refrigerator as claimed in claim 9, wherein the evaporator is integrated into the lid.

11. The refrigerator as claimed in claim 8, wherein the lid further includes side walls, and wherein bottom edges of the side walls abut against top edges of the lateral boundary walls of the first drawer in a sealing manner when the first drawer is in the inserted position.

12. The refrigerator as claimed in claim 11, wherein the top edges of the lateral boundary walls of the first drawer run diagonally from a top edge of the front boundary wall to a top edge of the rear boundary wall.

13. The refrigerator as claimed in claim 12, wherein a depth of the inner drawer is at least in part shorter than a depth of the first drawer.

14. The refrigerator as claimed in claim 13, further comprising a holder for holding bottles in an upright position, wherein the holder is disposed in a front region of the first drawer.

15. The refrigerator as claimed in claim 6, wherein at least one of the boundary walls of the first drawer includes a thermally insulating material.

16. The refrigerator as claimed in claim 6, wherein the first drawer includes a lid which is immovably joined to the refrigerator, and said first drawer further comprises sealing means disposed between top edges of the boundary walls of the first drawer and bottom edges of the lid.

17. The refrigerator as claimed in claim 6, wherein the inner drawer is displaceably mounted in the first drawer such that the inner drawer is displaced beyond the rear boundary wall of the first drawer into an interior space of the refrigerator when the first drawer is in a withdrawn position.

* * * * *